US009934752B2

(12) United States Patent
Ma et al.

(10) Patent No.: US 9,934,752 B2
(45) Date of Patent: Apr. 3, 2018

(54) DEMULTIPLEX TYPE DISPLAY DRIVING CIRCUIT

(71) Applicant: Wuhan China Star Optoelectronics Technology Co., Ltd., Wuhan (CN)

(72) Inventors: Liang Ma, Wuhan (CN); Mang Zhao, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 11 days.

(21) Appl. No.: 15/238,702

(22) Filed: Aug. 16, 2016

(65) Prior Publication Data

US 2017/0345384 A1 Nov. 30, 2017

(30) Foreign Application Priority Data

May 31, 2016 (CN) ..... 2016 1 0379791

(51) Int. Cl.
*G09G 3/36* (2006.01)

(52) U.S. Cl.
CPC ..... *G09G 3/3688* (2013.01); *G09G 3/3607* (2013.01); *G09G 3/3648* (2013.01); *G09G 2310/0289* (2013.01); *G09G 2310/0297* (2013.01); *G09G 2320/0219* (2013.01)

(58) Field of Classification Search
CPC ..... G09G 2310/027; G09G 2310/0297; G09G 3/3685; G09G 3/3696; G09G 3/3275; G09G 2310/0275; G09G 2310/0294
See application file for complete search history.

(56) References Cited

U.S. PATENT DOCUMENTS

2007/0057877 A1* 3/2007 Choi ..... G09G 3/3233 345/76
2007/0146002 A1* 6/2007 Hsieh ..... G09G 3/006 324/760.02
2014/0160172 A1* 6/2014 Lee ..... G09G 3/3607 345/690

* cited by examiner

*Primary Examiner* — Koosha Sharifi-Tafreshi
(74) *Attorney, Agent, or Firm* — Leong C. Lei

(57) ABSTRACT

The present invention provides a demultiplex type display driving circuit, including: a plurality of drive units. Each drive unit comprises three demultiplex modules, and each demultiplex module includes two switch elements. The first switch element and the second switch element are controlled to be alternately on with the first branch control signal and the second branch control signal. The third branch control signal controls the two switch elements of the second and the third demultiplex modules to be alternately on to sequentially input the data signal to the first, the second, the third and the fourth data lines. Thus, division one to four of the data signal can be achieved with the three branch control signals. In comparison with prior art, the amount of the branch control signals is decreased, and meanwhile, the CMOS transmission gate is employed to be the switch element in the demultiplex modules.

9 Claims, 6 Drawing Sheets

DEMULTIPLEX TYPE DISPLAY DRIVING CIRCUIT

FIELD OF THE INVENTION

The present invention relates to a liquid crystal display technology field, and more particularly to a demultiplex type display driving circuit.

BACKGROUND OF THE INVENTION

The panel display device, such as the Liquid Crystal Display (LCD) and the Organic Light Emitting Display (OLED) comprises a plurality of pixels aligned in array. Each pixel generally comprises sub pixels of red, green, blue, three colors. Each sub pixel is controlled by one gate line and one data line. The gate line is employed to control the on and off of the sub pixel, and the data line applies various data voltage signals to make the sub pixel show various gray scales, and thus for realizing the full color image display.

With the development of the display technology, the requirements of the people to the display qualities of the display device, such as the display brightness, the color reduction, the richness of the image color gets higher and higher. The display merely utilizing the red, green and blue, three primary colors can no longer satisfy the requirements of the people to the display device. Thereafter, the four colors display device having red, green, blue, white four colors is proposed. One white sub pixel is added in each pixel for forming the RGBW pixel structure constructed by the red sub pixel (R), the green sub pixel (G), the blue sub pixel (B) and the white sub pixel (W). In the same display image, the display device utilizing the RGBW pixel structure has the larger pixel pitch than the display device utilizing the RGB three colors sub pixels structure, and the added white sub pixel has high transmission rate. The RGBW four colors sub pixels structure display device has benefits of high transmission rate and high aperture ratio, and is pursued by the consumers.

Please refer to FIG. 1, which is a circuit structure diagram of the demultiplex type display driving circuit used in a RGBW four colors pixel structure display device according to prior art. The circuit comprises: a plurality of drive units, and each drive unit comprises: a demultiplex module 10', first, second, third and fourth data lines D1'-D4' which are mutually parallel, sequentially aligned and vertical, and sub pixels 20' of multiple rows, four columns, which are aligned in array; each sub pixel 20' is electrically coupled to the data line corresponded with the column where the sub pixel 20' is; specifically, the demultiplex module 10' comprises: first, second, third and fourth thin film transistors T1', T2', T3', T4'; gates of the first, the second, the third and the fourth thin film transistors T1', T2', T3', T4' are electrically coupled to first, second, third and fourth branch control signals Demux1', Demux2', Demux3' and Demux4', respectively, and sources are all electrically coupled to a data signal Input, and drains are electrically coupled to first, second, third and fourth data lines D1, D2', D3' and D4', respectively. The circuit can control the waveforms of the four branch control signals to respectively activate the four thin film transistors to achieve the one to four division function of the data signal Input. However, the amount of the branch control signals are many, which will increase the loading of the control signal Integrated Circuit (IC), and meanwhile the feedthrough effect occurs to the pixel while the thin film transistor is deactivated to make the outputted data signal unstable.

Please refer to FIG. 2, which is a circuit structure diagram of a demultiplex type display driving circuit used in another RGBW four colors pixel structure display device according to prior art. The circuit comprises: a plurality of drive units, and each drive unit comprises: a demultiplex module 10", first, second, third and fourth data lines D1"-D4" which are mutually parallel, sequentially aligned and vertical, and sub pixels 20" of multiple rows, four columns, which are aligned in array; each sub pixel 20" is electrically coupled to the data line corresponded with the column where the sub pixel 20" is; specifically, the demultiplex module 10" comprises: first, second, third and fourth Transmission Gates TG1', TG2', TG3', TG4'; the high voltage levels control ends of the first, the second, the third and the fourth Transmission Gates TG1', TG2', TG3', TG4' are electrically coupled to first, second, third and fourth branch control signals Demux1", Demux2", Demux3" and Demux4", respectively, and the low voltage level control ends are electrically coupled to fifth, sixth, seventh and eighth branch control signals Demux5", Demux6", Demux7" and Demux8", respectively, all the input ends are electrically coupled to the data signal Input, and the output ends are respectively coupled to first, second, third and fourth data lines D1", D2", D3" and D4", respectively; the first branch control signal Demux1" and the fifth branch control signal Demux5" are inverse in phase, and the second branch control signal Demux2" and the sixth branch control signal Demux6" are inverse in phase, and the third branch control signal Demux3" and the seventh branch control signal Demux7" are inverse in phase, and the fourth branch control signal Demux4" and the eighth branch control signal Demux8" are inverse in phase. The circuit can control the waveforms of the eight branch control signals to respectively activate the four CMOS transmission gates to achieve the one to four division function of the data signal Input, and raise the charge rate of the pixel for stabilizing the pixel voltage. However, the circuit increases the amount of the branch control signals in advance, which tremendously increase the loading of the control signal IC.

SUMMARY OF THE INVENTION

An objective of the present invention is to provide a demultiplex type display driving circuit, which can decrease the amount of the branch control signals, and can reduce the loading of the control signal IC to stable the outputted data signal and to eliminate the feed through effect of the pixel.

For realizing the aforesaid objective, the present invention provides a demultiplex type display driving circuit, comprising: a plurality of drive units, wherein each drive unit comprises: a first demultiplex module, a second demultiplex module, a third demultiplex module, first, second, third and fourth data lines which are mutually parallel, sequentially aligned and vertical, and sub pixels of multiple rows, four columns, which are aligned in array;

the sub pixel is electrically coupled to a data line corresponded with the column where the sub pixel is;

the first demultiplex module comprises: a first switch element and a second switch element, and the second demultiplex module comprises: a third switch element and a fourth switch element, and third demultiplex module comprises: a fifth switch element and a sixth switch element;

all the first, the second, the third, the fourth, the fifth and the sixth switch elements comprise: a control end, an input end and an output end;

the control end of the first switch element is electrically coupled to a first branch control signal, and the input end is electrically coupled to a data signal, and the output end is electrically coupled to the input end of the third switch element and the input end of the fourth switch element;

the control end of the second switch element is electrically coupled to a second branch control signal, and the input end is electrically coupled to the data signal, and the output end is electrically coupled to the input end of the fifth switch element and the input end of the sixth switch element;

the control end of the third switch element is electrically coupled to a third branch control signal, and the output end is electrically coupled to a first data line;

the control end of the fourth switch element is electrically coupled to a third branch control signal, and the output end is electrically coupled to a second data line;

the control end of the fifth switch element is electrically coupled to a third branch control signal, and the output end is electrically coupled to a third data line;

the control end of the sixth switch element is electrically coupled to a third branch control signal, and the output end is electrically coupled to a fourth data line;

pulse durations of the first branch control signal and the second branch control signal are the same, and a pulse duration of the third branch control signal is a half of the pulse duration of the first branch control signal, and the first switch element and the second switch element are alternately on, and the third switch element and the fourth switch element are alternately on, and the fifth switch element and the sixth switch element are alternately on to sequentially input the data signals to the first, the second, the third and the fourth data lines.

The demultiplex type display driving circuit further comprises: a first inverter and a second inverter;

an input end of the first inverter receives the third branch control signal, and an output end of the first inverter is electrically coupled to an output end of the second inverter; an input end of the second inverter is coupled to the third branch control signal;

all the third switch element, the fourth switch element, the fifth switch element and the sixth switch element are CMOS transmission gates;

the input ends and the output ends of the third switch element, the fourth switch element, the fifth switch element and the sixth switch element respectively correspond to an input end and an output end of the CMOS transmission gate;

the control ends of the third switch element, the fourth switch element, the fifth switch element and the sixth switch element comprise: a high voltage level control and a low voltage level control end of the CMOS transmission gate;

the high voltage level control end of the third switch element is electrically coupled to the third branch control signal, and the low voltage level control end is electrically coupled to the output end of the first inverter;

the high voltage level control end of the fourth switch element is electrically coupled to the output end of the first inverter, and the low voltage level control end is electrically coupled to the third branch control signal;

the high voltage level control end of the fifth switch element is electrically coupled to the third branch control signal, and the low voltage level control end is electrically coupled to the output end of the first inverter;

the high voltage level control end of the sixth switch element is electrically coupled to the output end of the first inverter, and the low voltage level control end is electrically coupled to the third branch control signal.

Both the first switch element and the second switch element are N type TFTs, and the control ends, the input ends and the output ends of the first switch element and the second switch element respectively correspond to a gate, a source and a drain of the N type TFT.

The demultiplex type display driving circuit further comprises: a third inverter, a fourth inverter, a fifth inverter and a sixth inverter;

the input end of the third inverter receives the first branch control signal, and an output end of the third inverter is electrically coupled to an output end of the sixth inverter; an input end of the fourth inverter receives the second branch control signal, and an output end of the fourth inverter is electrically coupled to an output end of the fifth inverter; an input end of the fifth inverter receives the second branch control signal; an input end of the sixth inverter receives the first branch control signal;

both the first switch element and the second switch element are CMOS transmission gates;

the input ends and the output ends of the first switch element and the second switch element respectively correspond to an input end and an output end of the CMOS transmission gate;

the control ends of the first switch element and the second switch element comprise: a high voltage level control and a low voltage level control end of the CMOS transmission gate;

the high voltage level control of the first switch element is electrically coupled to the first branch control signal, and the low voltage level control end is electrically coupled to the output end of the third inverter;

the high voltage level control of the second switch element is electrically coupled to the second branch control signal, and the low voltage level control end is electrically coupled to the output end of the fourth inverter.

The first branch control signal and the second branch control signal are inverse in phase.

both the third switch element and the fifth element are N type TFTs, and both the fourth switch element and the sixth switch element are P type TFT;

the control ends, the input ends and the output ends of the third switch element and the fifth switch element respectively correspond to a gate, a source and a drain of the N type TFT;

the control ends, the input ends and the output ends of the fourth switch element and the sixth switch element respectively correspond to a gate, a source and a drain of the P type TFT.

The sub pixels of multiple rows, four columns in each drive unit respectively are: red sub pixels of one column, green sub pixels of one column, blue sub pixels of one column and white sub pixels of one column, which are sequentially aligned.

the first branch control signal, the second branch control signal and the third branch control signal are combined with one another to sequentially input the data signal to the first, the second, the third and the fourth data lines to respectively charge the red sub pixel, the green sub pixel, the blue sub pixel and the white sub pixel.

as charging the red sub pixel, the first switch element, the third switch element and the fifth switch element are on, and the second switch element, the fourth switch element and the sixth switch element are off;

as charging the green sub pixel, the first switch element, the fourth switch element and the sixth switch element are on, and the second switch element, the third switch element and the fifth switch element are off;

as charging the blue sub pixel, the second switch element, the third switch element and the fifth switch element are on, and the first switch element, the fourth switch element and the sixth switch element are off;

as charging the white sub pixel, the second switch element, the fourth switch element and the sixth switch element are on, and the first switch element, the third switch element and the fifth switch element are off.

The benefits of the present invention are: the present invention provides a demultiplex type display driving circuit, including: a plurality of drive units. Each drive unit comprises three demultiplex modules, and each demultiplex module includes two switch elements. The first switch element and the second switch element are controlled to be alternately on with the first branch control signal and the second branch control signal. The third branch control signal controls the two switch elements of the second and the third demultiplex modules to be alternately on to sequentially input the data signal to the first, the second, the third and the fourth data lines for respectively discharging the red, the green, the blue and the white sub pixels. Thus, one to four division of the data signal can be achieved with the three branch control signals. In comparison with prior art, under the premise of achieving the one to four division of the data signal, the amount of the branch control signals is decreased, and meanwhile, the CMOS transmission gate is employed to be the switch element in the demultiplex modules. It can effectively reduce the equivalent conduction resistance of the demultiplex module, and reduce the loading of the control signal IC to stable the output signal and to eliminate the feed through effect of the pixel.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

Figure 1:
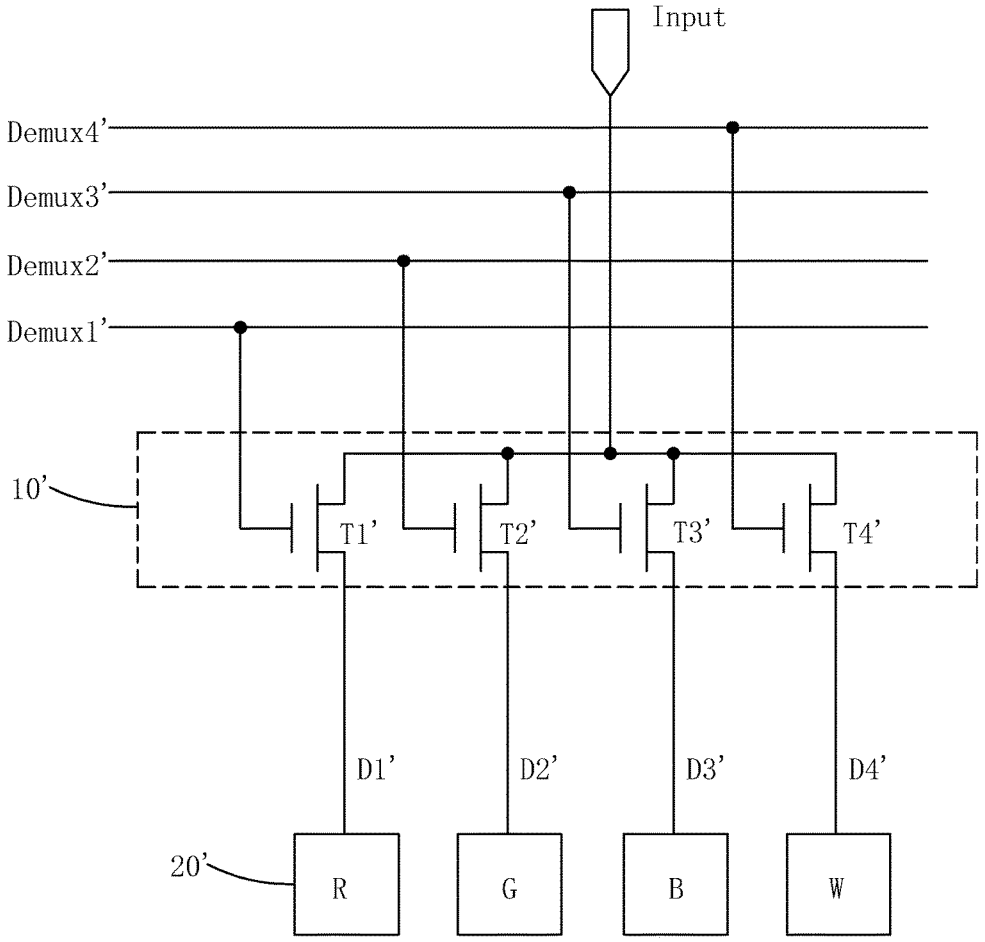
Fig. 1 (Prior Art)
FIG. 1 is a circuit structure diagram of a demultiplex type display driving circuit used in a RGBW four colors pixel structure display device according to prior art.
Figure 2:
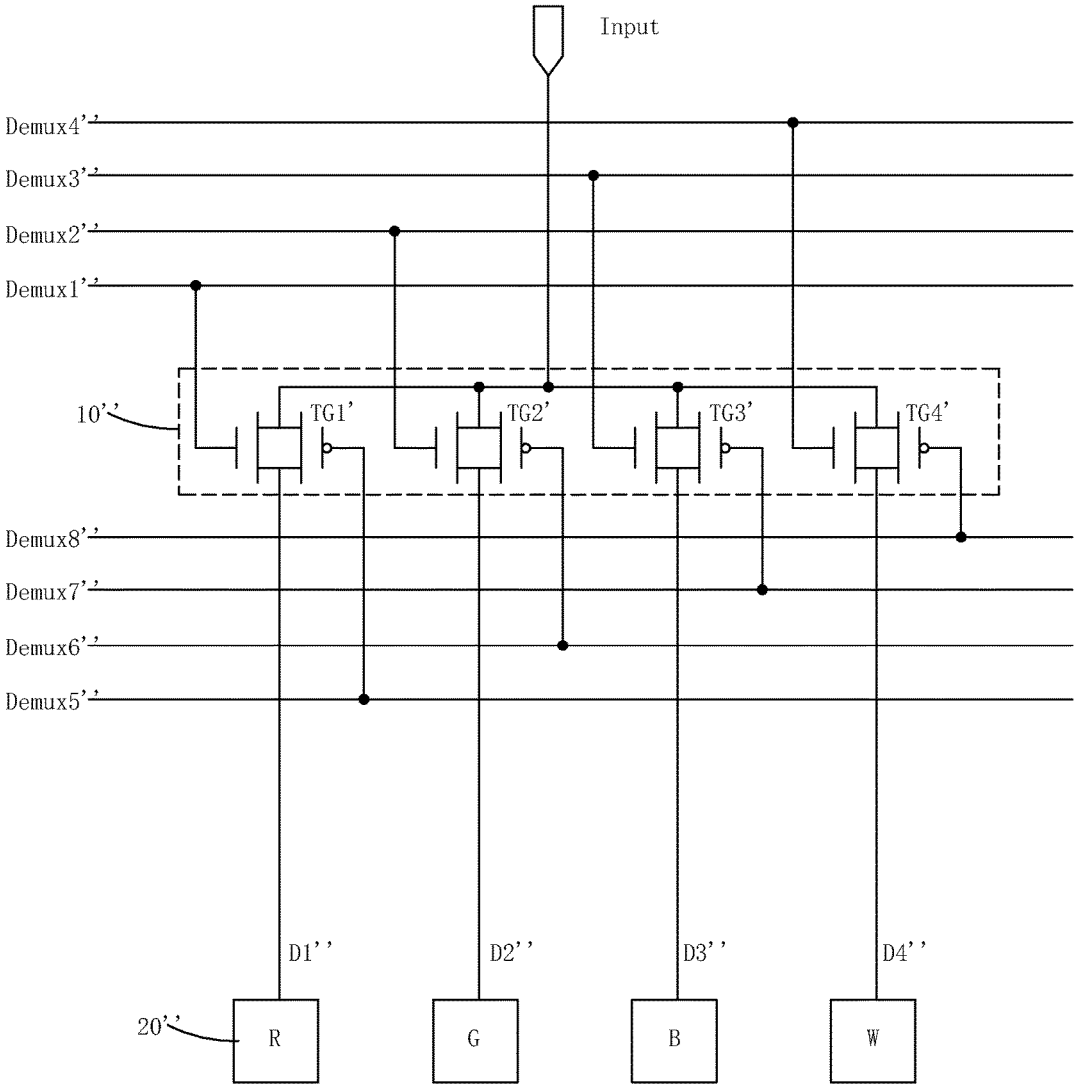
Fig. 2 (Prior Art)
FIG. 2 is a circuit structure diagram of a demultiplex type display driving circuit used in another RGBW four colors pixel structure display device according to prior art.

For better explaining the technical solution and the effect of the present invention, the present invention will be further described in detail with the accompanying drawings and the specific embodiments.

Please refer from FIG. 3 to FIG. 6. The present invention provides a demultiplex type display driving circuit, comprising: a plurality of drive units, wherein each drive unit comprises: a first demultiplex module 10, a second demultiplex module 20, a third demultiplex module 30, first, second, third and fourth data lines D1, D2, D3, D4 which are mutually parallel, sequentially aligned and vertical, and sub pixels 40 of multiple rows, four columns, which are aligned in array;

the sub pixel 40 is electrically coupled to a data line corresponded with the column where the sub pixel 40 is, and besides, a scan line is further located corresponding to the sub pixels of each row, and a switch TFT is located corresponding to each sub pixel, and a gate of the switch TFT is electrically coupled to the scan line corresponded with the row where the sub pixel 40 is, and a source is electrically coupled to the data line corresponded with the column where the sub pixel 40 is, and a drain is electrically coupled to the pixel electrode in the sub pixel 40.

the first demultiplex module 10 comprises: a first switch element 11 and a second switch element 12, and the second demultiplex module 20 comprises: a third switch element 21 and a fourth switch element, 22, and third demultiplex module 30 comprises: a fifth switch element 31 and a sixth switch element 32; all the first, the second, the third, the fourth, the fifth and the sixth switch elements 11, 12, 21, 22, 31, 32 comprise: a control end, an input end and an output end; the control end of the first switch element 11 is electrically coupled to a first branch control signal Demux1, and the input end is electrically coupled to a data signal Input, and the output end is electrically coupled to the input end of the third switch element 21 and the input end of the fourth switch element 22; the control end of the second switch element 12 is electrically coupled to a second branch control signal Demux2, and the input end is electrically coupled to the data signal Input, and the output end is electrically coupled to the input end of the fifth switch element 31 and the input end of the sixth switch element 32; the control end of the third switch element 21 is electrically coupled to a third branch control signal Demux3, and the output end is electrically coupled to a first data line D1; the control end of the fourth switch element 22 is electrically coupled to a third branch control signal Demux3, and the output end is electrically coupled to a second data line D2; the control end of the fifth switch element 31 is electrically coupled to a third branch control signal Demux3, and the output end is electrically coupled to a third data line D3; the control end of the sixth switch element 32 is electrically coupled to a third branch control signal Demux3, and the output end is electrically coupled to a fourth data line D4.

Specifically, pulse durations of the first branch control signal Demux1 and the second branch control signal Demux2 are the same, and a pulse duration of the third branch control signal Demux3 is a half of the pulse duration of the first branch control signal Demux1, and the first switch element 11 and the second switch element 12 are alternately on, and the third switch element 21 and the fourth switch element 22 are alternately on, and the fifth switch element 31 and the sixth switch element 32 are alternately on to sequentially input the data signals Input to the first, the second, the third and the fourth data lines D1, D2, D3, D4, and thus division one to four of the data signal Input can be achieved with the three branch control signals to effectively decrease the amount of the branch control signals and to reduce the loading of the control signal IC.

Specifically, the sub pixels 40 of multiple rows, four columns in each drive unit respectively are: red sub pixels R of one column, green sub pixels G of one column, blue sub pixels B of one column and white sub pixels W of one column, which are sequentially aligned. The first branch control signal Demux1, the second branch control signal Demux2 and the third branch control signal Demux3 are combined with one another to sequentially input the data signal Input to the first, the second, the third and the fourth data lines D1, D2, D3, D4 to respectively charge the red sub pixel R, the green sub pixel G, the blue sub pixel B and the white sub pixel W.

Specifically, the first, the second, the third, the fourth, the fifth and the sixth switch elements 11, 12, 21, 22, 31, 32 can use the corresponding switch element, such as N type TFT, P type TFT, CMOS transmission gate according to the design requirement.

Figure 3:
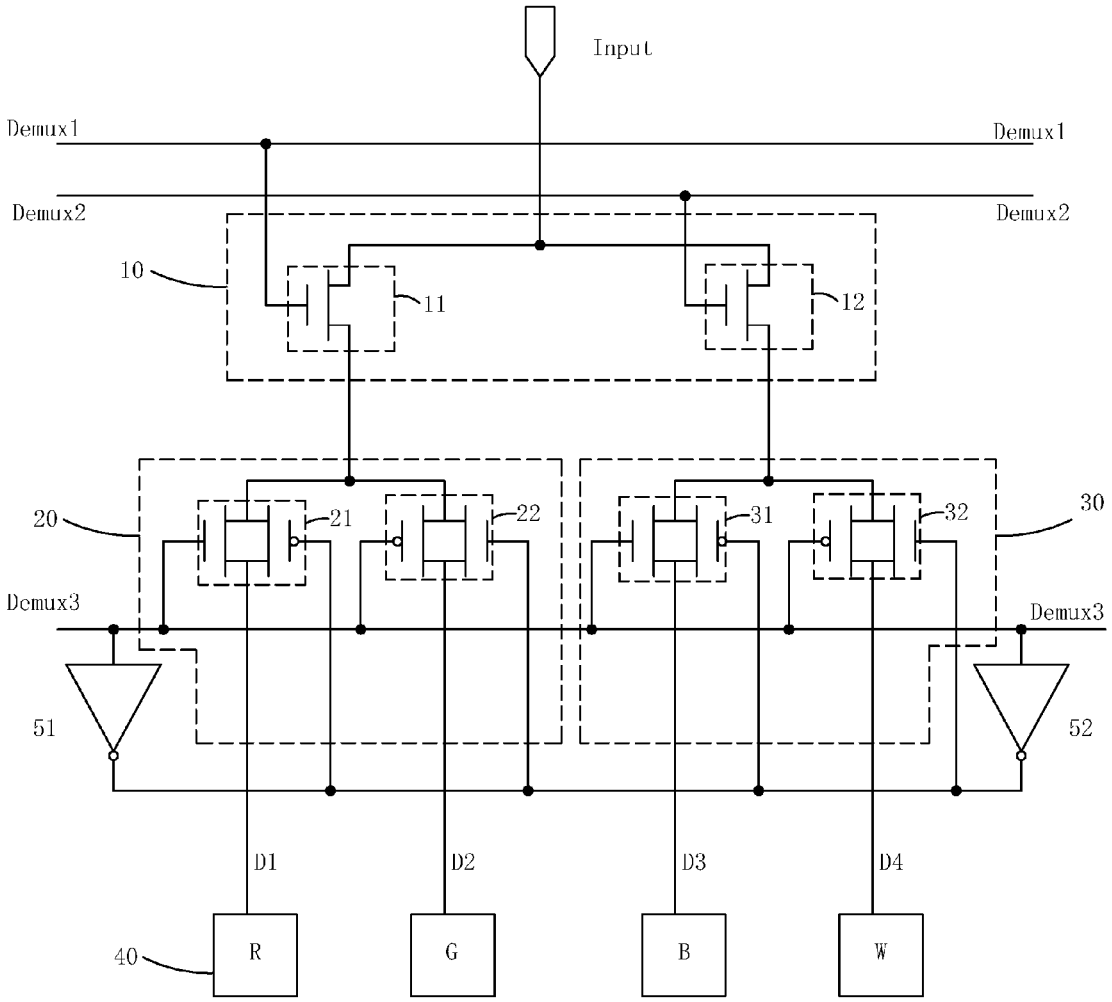
FIG. 3 is a circuit structure diagram of the first embodiment according to the demultiplex type display driving circuit of the present invention.

Please refer to FIG. 3. In the first embodiment of the present invention, both the first switch element 11 and the second switch element 12 are N type TFTs, and the control ends, the input ends and the output ends of the first switch element 11 and the second switch element 12 respectively correspond to a gate, a source and a drain of the N type TFT. Namely, a gate of the first switch element 11 receives the first branch control signal Demux1, and a source receives the data signal Input, and a drain is electrically coupled to the input ends of the third switch element 21 and the fourth switch element 22; a gate of the second switch element 12 receives the second branch control signal Demux2, and source receives the data signal Input, and a drain is electrically coupled to the input ends of the fifth switch element 31 and the sixth switch elements 32.

All the third switch element 21, the fourth switch element 22, the fifth switch element 31 and the sixth switch element 32 are CMOS transmission gates. Then, for achieving the normal work of the CMOS transmission gates, the circuit further comprises a first inverter 51 and a second inverter 52, wherein an input end of the first inverter 51 receives the third branch control signal Demux3, and an output end of the first inverter 51 is electrically coupled to an output end of the second inverter 52; an input end of the second inverter 52 is coupled to the third branch control signal Demux3.

Correspondingly, the input ends and the output ends of the third switch element 21, the fourth switch element 22, the fifth switch element 31 and the sixth switch element 32 respectively correspond to an input end and an output end of the CMOS transmission gate, and the control ends of the third switch element 21, the fourth switch element 22, the fifth switch element 31 and the sixth switch element 32 comprise: a high voltage level control and a low voltage level control end of the CMOS transmission gate. Namely, the high voltage level control end of the third switch element 21 is electrically coupled to the third branch control signal Demux3, and the low voltage level control end is electrically coupled to the output end of the first inverter 52, and an input end is electrically coupled to the drain of the first switch element 11, and an output end is electrically coupled to the first data line D1; the high voltage level control end of the fourth switch element 22 is electrically coupled to the output end of the first inverter 52, and the low voltage level control end is electrically coupled to the third branch control signal Demux3, and an input end is electrically coupled to the drain of the first switch element 11, and an output end is electrically coupled to the second data line D2; the high voltage level control end of the fifth switch element 31 is electrically coupled to the third branch control signal Demux3, and the low voltage level control end is electrically coupled to the output end of the first inverter 51, and an input end is electrically coupled to the drain of the first switch element 12, and an output end is electrically coupled to the third data line D3; the high voltage level control end of the sixth switch element 32 is electrically coupled to the output end of the first inverter 51, and the low voltage level control end is electrically coupled to the third branch control signal Demux3, and an input is electrically coupled to the drain of the second switch element 12, and an output end is electrically coupled to the fourth data line D4.

Figure 5:
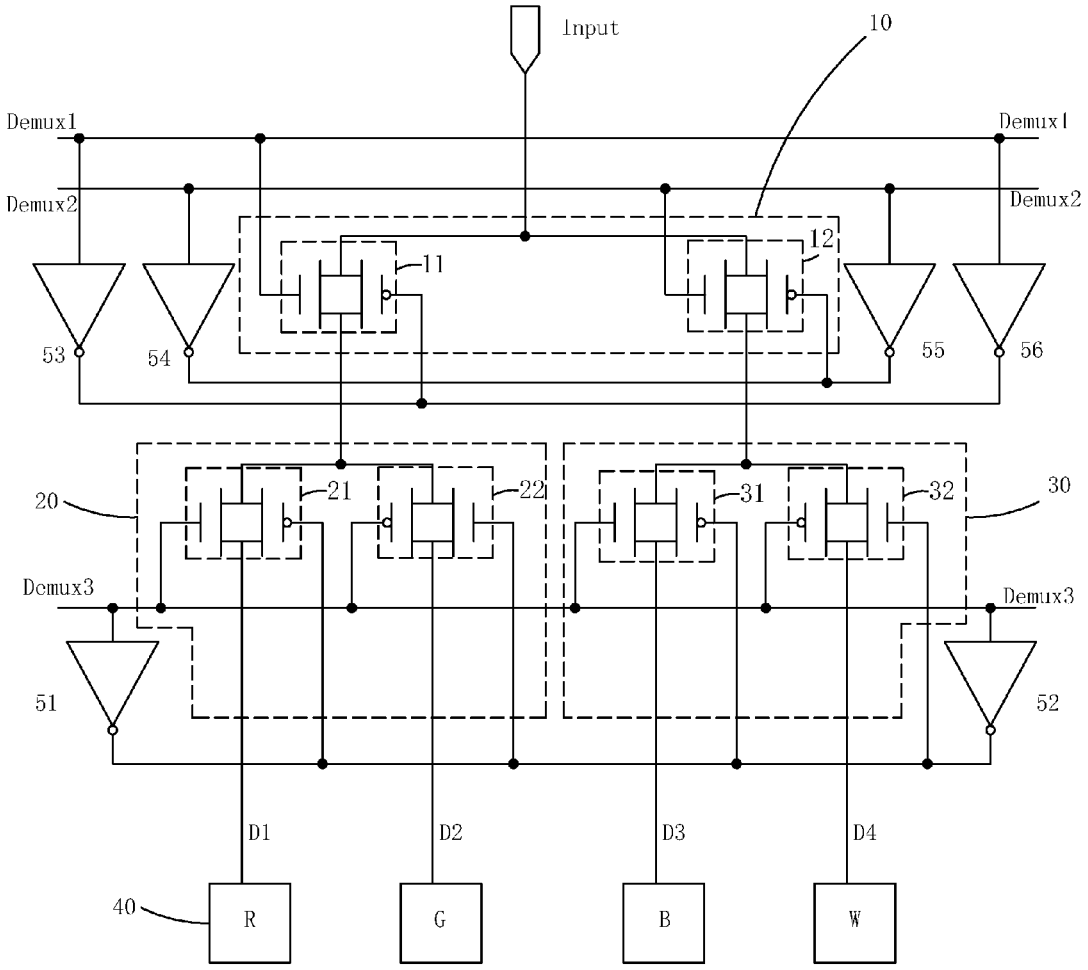
FIG. 5 is a circuit structure diagram of the second embodiment according to the demultiplex type display driving circuit of the present invention.

Please refer to FIG. 5, which is the second embodiment of the present invention, in which the difference from the first embodiment is that the first switch element 11 and the second switch element 12 are CMOS transmission gates, too, and a third inverter 53, a fourth inverter 54, a fifth inverter 55 and a sixth inverter 56 are added for controlling the CMOS transmission gates. The input end of the third inverter 53 receives the first branch control signal Demux1, and an output end of the third inverter 53 is electrically coupled to an output end of the sixth inverter 56; an input end of the fourth inverter 54 receives the second branch control signal Demux2, and an output end of the fourth inverter 54 is electrically coupled to an output end of the fifth inverter 55; an input end of the fifth inverter 55 receives the second branch control signal Demux2; an input end of the sixth inverter 56 receives the first branch control signal Demux1. Correspondingly, the input ends and the output ends of the first switch element 11 and the second switch element 12 respectively correspond to an input end and an output end of the CMOS transmission gate; the control ends of the first switch element 11 and the second switch element 12 comprise: a high voltage level control and a low voltage level control end of the CMOS transmission gate. Namely, the high voltage level control of the first switch element 11 is electrically coupled to the first branch control signal Demux1, and the low voltage level control end is electrically coupled to the output end of the third inverter 53, and an input end is electrically coupled to the data signal Input, and an output end is electrically coupled to the input ends of the third switch element 21 and the fourth switch element 22; the high voltage level control of the second switch element 12 is electrically coupled to the second branch control signal Demux2, and the low voltage level control end is electrically coupled to the output end of the fourth inverter 54, and an input end is electrically coupled to the data signal Input, and an output end is electrically coupled to the input ends of the fifth switch element 31 and the sixth switch element 32. The reset is the same as the first embodiment. The repeated description is omitted here.

Figure 6:
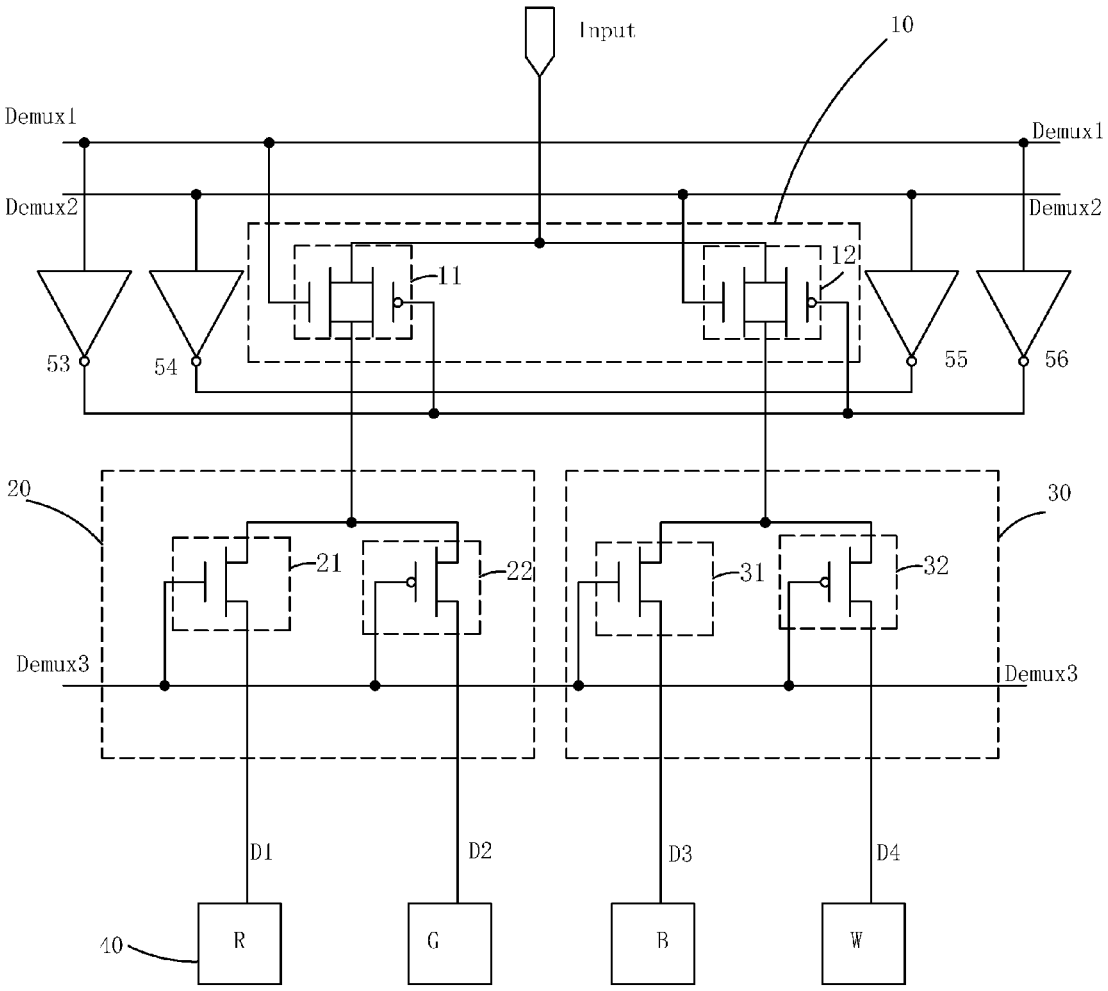
FIG. 6 is a circuit structure diagram of the third embodiment according to the demultiplex type display driving circuit of the present invention.

Please refer to FIG. 6, which is the third embodiment of the present invention. The difference of the third embodiment and the second embodiment is that both the third switch element 21 and the fifth element 31 are N type TFTs, and both the fourth switch element 22 and the sixth switch element 32 are P type TFT. Correspondingly, the TFT only has the control end, and thus the third embodiment does not comprise the first inverter 51 and the second inverter 52. Correspondingly, the control ends, the input ends and the output ends of the third switch element 21 and the fifth switch element 31 respectively correspond to a gate, a source and a drain of the N type TFT; the control ends, the input ends and the output ends of the fourth switch element 22 and the sixth switch element 32 respectively correspond to a gate, a source and a drain of the P type TFT. Namely, a gate of the third switch element 21 receives the third branch control signal Demux3, and a source is electrically coupled to the output end of the fifth CMOS transmission gate TG5, and a drain is electrically coupled to the first data line D1; a gate of the fourth switch element 22 receives the third branch control signal Demux3, and a source is electrically coupled to output end of the fifth CMOS transmission gate TG5, and a drain is electrically coupled to the second data line D2, and a gate of the fifth switch element 31 receives the third branch control signal Demux3, and a source is electrically coupled to the output end of the sixth CMOS transmission gate TG6, and a drain is electrically coupled to the third data line D3, and a gate of the sixth switch element 32 receives the third branch control signal Demux3, and a source is electrically coupled to the output end of the sixth CMOS transmission gate TG6, and a drain is electrically coupled to the fourth data line D4. The reset is the same as the second embodiment. The repeated description is omitted here.

Specifically, in the present invention, the first branch control signal Demux1, the second branch control signal Demux2 and the third branch control signal Demux3 are combined with one another to sequentially input the data signal Input to the first, the second, the third and the fourth data lines D1, D2, D3, D4 to respectively charge the red sub pixel R, the green sub pixel G, the blue sub pixel B and the white sub pixel W. As charging the red sub pixel, the first switch element 11, the third switch element 21 and the fifth switch element 31 are on, and the second switch element 12, the fourth switch element 22 and the sixth switch element 32 are off; as charging the green sub pixel, the first switch element 11, the fourth switch element 22 and the sixth switch element 32 are on, and the second switch element 12, the third switch element 21 and the fifth switch element 31 are off; as charging the blue sub pixel, the second switch element 12, the third switch element 21 and the fifth switch element 31 are on, and the first switch element 11, the fourth switch element 22 and the sixth switch element 32 are off; as charging the white sub pixel, the second switch element 12, the fourth switch element 22 and the sixth switch element 32 are on, and the first switch element 11, the third switch element 21 and the fifth switch element 31 are off.

Figure 4:
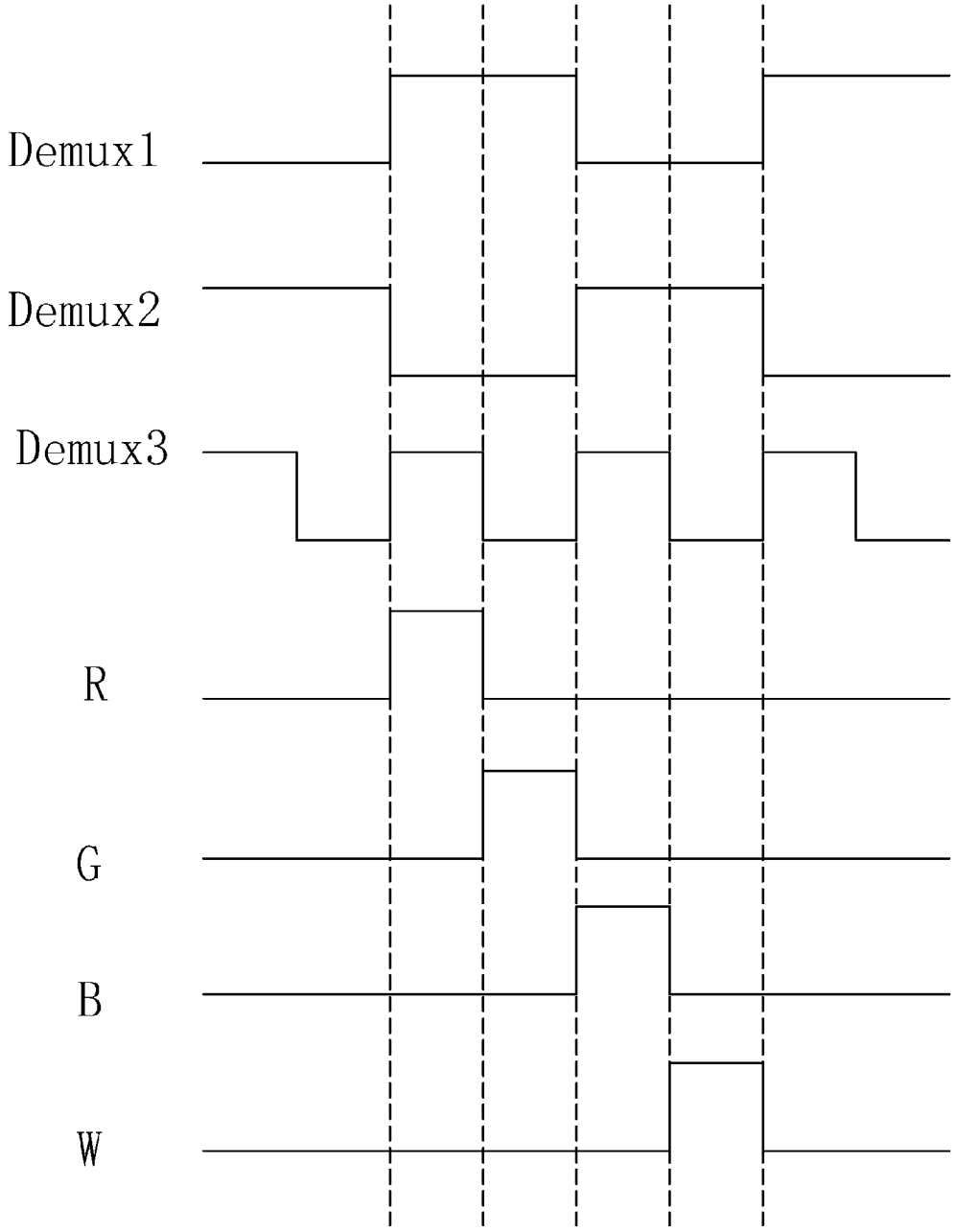
FIG. 4 is a sequence diagram of the demultiplex type display driving circuit according to the present invention.

Specifically, referring to FIG. 4 with FIG. 3 at the same time, in the aforesaid first embodiment, as charging the red sub pixel R, the data signal Input is inputted to the sources of the first switch element 11 and the second switch element 12, and the first branch control signal Demux1 is high voltage level to make the first switch element 11 be on, and the second branch control signal Demux2 is low voltage level to make the second switch element 12 be off. The data signal Input is inputted to the input ends of the third switch element 21 and the fourth switch element 22 through the first switch element 12, and the third branch control signal Demux3 is high voltage level, which becomes low voltage level after the function of the first inverter 51 and the second inverter 52 to make the high voltage level control end of the third switch element 21 appear to be high voltage level, and to make the low voltage control end appear to be low voltage level, and to make the high voltage level control end of the fourth switch element 22 appear to be low voltage level, and to make the low voltage control end appear to be high voltage level. Thus, the third switch element 21 is on and the fourth switch element 22 is off, and the data signal Input is inputted to the first data line D1 through the third switch element 21 for charging the red sub pixel R.

As charging the green sub pixel G, the data signal Input is inputted to the sources of the first switch element 11 and the second switch element 12, and the first branch control signal Demux1 is high voltage level to make the first switch element 11 be on, and the second branch control signal Demux2 is low voltage level to make the second switch element 12 be off. The data signal Input is inputted to the input ends of the third switch element 21 and the fourth switch element 22 through the first switch element 12, and the third branch control signal Demux3 is low voltage level, which becomes high voltage level after the function of the first inverter 51 and the second inverter 52 to make the high voltage level control end of the third switch element 21 appear to be low voltage level, and to make the low voltage control end appear to be high voltage level, and to make the high voltage level control end of the fourth switch element 22 appear to be high voltage level, and to make the low voltage control end appear to be low voltage level. Thus, the third switch element 21 is off and the fourth switch element 22 is on, and the data signal Input is inputted to the second data line D2 through the fourth switch element 22 for charging the green sub pixel G.

As charging the blue sub pixel B, the data signal Input is inputted to the sources of the first switch element 11 and the second switch element 12, and the first branch control signal Demux1 is low voltage level to make the first switch element 11 be off, and the second branch control signal Demux2 is high voltage level to make the second switch element 12 be on. The data signal Input is inputted to the input ends of the fifth switch element 31 and the sixth switch element 32 through the second switch element 12, and the third branch control signal Demux3 is high voltage level, which becomes low voltage level after the function of the first inverter 51 and the second inverter 52 to make the high voltage level control end of the fifth switch element 31 appear to be high voltage level, and to make the low voltage control end appear to be low voltage level, and to make the high voltage level control end of the sixth switch element 32 appear to be low voltage level, and to make the low voltage control end appear to be high voltage level. Thus, the fifth switch element 31 is on and the sixth switch element 32 is off, and the data signal Input is inputted to the third data line D3 through the fifth switch element 31 for charging the blue sub pixel B.

As charging the white sub pixel W, the data signal Input is inputted to the sources of the first switch element 11 and the second switch element 12, and the first branch control signal Demux1 is low voltage level to make the first switch element 11 be off, and the second branch control signal Demux2 is high voltage level to make the second switch element 12 be on. The data signal Input is inputted to the input ends of the fifth switch element 31 and the sixth switch element 32 through the second switch element 12, and the third branch control signal Demux3 is low voltage level, which becomes high voltage level after the function of the first inverter 51 and the second inverter 52 to make the high voltage level control end of the fifth switch element 31 appear to be low voltage level, and to make the low voltage control end appear to be high voltage level, and to make the high voltage level control end of the sixth switch element 32 appear to be high voltage level, and to make the low voltage control end appear to be low voltage level. Thus, the fifth switch element 31 is off and the sixth switch element 32 is on, and the data signal Input is inputted to the fourth data line D4 through the sixth switch element 32 for charging the white sub pixel W.

The working procedures of the second and the third embodiment are similar as the first embodiment. As charging the red sub pixel R, the first branch control signal Demux1, the second branch control signal Demux2 and the third branch control signal Demux3 are controlled to make the data signal Input charge the red sub pixel R through the first switch element 11 and the third switch element 21; as charging the green sub pixel G, the first branch control signal Demux1, the second branch control signal Demux2 and the third branch control signal Demux3 are controlled to make the data signal Input charge the green sub pixel G through the first switch element 11 and the fourth switch element 22; as charging the blue sub pixel B, the first branch control signal Demux1, the second branch control signal Demux2 and the third branch control signal Demux3 are controlled to make the data signal Input charge the blue sub pixel B through the second switch element 12 and the fifth switch element 31; as charging the white sub pixel W, the first branch control signal Demux1, the second branch control signal Demux2 and the third branch control signal Demux3 are controlled to make the data signal Input charge the white sub pixel W through the second switch element 12 and the sixth switch element 32, and the repeated description is omitted here.

In the first, the second and the third embodiments, with the circuit design, only three branch control signals are utilized to achieve one to four division of the data signal Input. In comparison with prior art, the amount of the branch control signals is decreased and the loading of the control signal IC is reduced, and meanwhile, the CMOS transmission gate is employed to be the switch element. It can effectively reduce the equivalent conduction resistance of the demultiplex module, and reduce the loading of the control signal IC to stable the output signal and to eliminate the feed through effect of the pixel.

In conclusion, the present invention provides a demultiplex type display driving circuit, including: a plurality of drive units. Each drive unit comprises three demultiplex modules, and each demultiplex module includes two switch elements. The first switch element and the second switch element are controlled to be alternately on with the first branch control signal and the second branch control signal. The third branch control signal controls the two switch elements of the second and the third demultiplex modules to be alternately on to sequentially input the data signal to the first, the second, the third and the fourth data lines for respectively discharging the red, the green, the blue and the white sub pixels. Thus, one to four division of the data signal can be achieved with the three branch control signals. In comparison with prior art, under the premise of achieving the one to four division of the data signal, the amount of the branch control signals is decreased, and meanwhile, the CMOS transmission gate is employed to be the switch element in the demultiplex modules. It can effectively reduce the equivalent conduction resistance of the demultiplex module, and reduce the loading of the control signal IC to stable the output signal and to eliminate the feed through effect of the pixel.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A demultiplex type display driving circuit, comprising: a plurality of drive units, wherein each drive unit comprises: a first demultiplex module (10), a second demultiplex module (20), a third demultiplex module (30), first, second, third and fourth data lines (D1, D2, D3, D4) which are mutually parallel, sequentially aligned and vertical, and sub pixels (40) of multiple rows, four columns, which are aligned in array;

the sub pixel (40) is electrically coupled to a data line corresponded with the column where the sub pixel (40) is;

the first demultiplex module (10) comprises: a first switch element (11) and a second switch element (12), and the second demultiplex module (20) comprises: a third switch element (21) and a fourth switch element, (22), and third demultiplex module (30) comprises: a fifth switch element (31) and a sixth switch element (32);

all the first, the second, the third, the fourth, the fifth and the sixth switch elements (11, 12, 21, 22, 31, 32) comprise: a control end, an input end and an output end;

the control end of the first switch element (11) is electrically coupled to a first branch control signal (Demux1), and the input end is electrically coupled to a data signal (Input), and the output end is electrically coupled to the input end of the third switch element (21) and the input end of the fourth switch element (22);

the control end of the second switch element (12) is electrically coupled to a second branch control signal (Demux2), and the input end is electrically coupled to the data signal (Input), and the output end is electrically coupled to the input end of the fifth switch element (31) and the input end of the sixth switch element (32);

the control end of the third switch element (21) is electrically coupled to a third branch control signal (Demux3), and the output end is electrically coupled to a first data line (D1);

the control end of the fourth switch element (22) is electrically coupled to a third branch control signal (Demux3), and the output end is electrically coupled to a second data line (D2);

the control end of the fifth switch element (31) is electrically coupled to a third branch control signal (Demux3), and the output end is electrically coupled to a third data line (D3);

the control end of the sixth switch element (32) is electrically coupled to a third branch control signal (Demux3), and the output end is electrically coupled to a fourth data line (D4);

pulse durations of the first branch control signal (Demux1) and the second branch control signal (Demux2) are the same, and a pulse duration of the third branch control signal (Demux3) is a half of the pulse duration of the first branch control signal (Demux1), and the first switch element (11) and the second switch element (12) are alternately on, and the third switch element (21) and the fourth switch element (22) are alternately on, and the fifth switch element (31) and the sixth switch element (32) are alternately on to sequentially input the data signals (Input) to the first, the second, the third and the fourth data lines (D1, D2, D3, D4).

2. The demultiplex type display driving circuit according to claim 1, further comprising: a first inverter (51) and a second inverter (52);

an input end of the first inverter (51) receives the third branch control signal (Demux3), and an output end of the first inverter (51) is electrically coupled to an output end of the second inverter (52); an input end of the second inverter (52) is coupled to the third branch control signal (Demux3);

all the third switch element (21), the fourth switch element (22), the fifth switch element (31) and the sixth switch element (32) are CMOS transmission gates;

the input ends and the output ends of the third switch element (21), the fourth switch element (22), the fifth switch element (31) and the sixth switch element (32) respectively correspond to an input end and an output end of the CMOS transmission gate;

the control ends of the third switch element (21), the fourth switch element (22), the fifth switch element (31) and the sixth switch element (32) comprise: a high voltage level control and a low voltage level control end of the CMOS transmission gate;

the high voltage level control end of the third switch element (21) is electrically coupled to the third branch control signal (Demux3), and the low voltage level control end is electrically coupled to the output end of the first inverter (52);

the high voltage level control end of the fourth switch element (22) is electrically coupled to the output end of the first inverter (52), and the low voltage level control end is electrically coupled to the third branch control signal (Demux3);

the high voltage level control end of the fifth switch element (31) is electrically coupled to the third branch control signal (Demux3), and the low voltage level control end is electrically coupled to the output end of the first inverter (51);

the high voltage level control end of the sixth switch element (32) is electrically coupled to the output end of the first inverter (51), and the low voltage level control end is electrically coupled to the third branch control signal (Demux3).

3. The demultiplex type display driving circuit according to claim 1, wherein both the first switch element (11) and the second switch element (12) are N type TFTs, and the control ends, the input ends and the output ends of the first switch element (11) and the second switch element (12) respectively correspond to a gate, a source and a drain of the N type TFT.

4. The demultiplex type display driving circuit according to claim 1, further comprising: a third inverter (53), a fourth inverter (54), a fifth inverter (55) and a sixth inverter (56);

the input end of the third inverter (53) receives the first branch control signal (Demux1), and an output end of the third inverter (53) is electrically coupled to an output end of the sixth inverter (56); an input end of the fourth inverter (54) receives the second branch control signal (Demux2), and an output end of the fourth inverter (54) is electrically coupled to an output end of the fifth inverter (55); an input end of the fifth inverter (55) receives the second branch control signal (Demux2); an input end of the sixth inverter (56) receives the first branch control signal (Demux1);

both the first switch element (11) and the second switch element (12) are CMOS transmission gates;

the input ends and the output ends of the first switch element (11) and the second switch element (12) respectively correspond to an input end and an output end of the CMOS transmission gate;

the control ends of the first switch element (11) and the second switch element (12) comprise: a high voltage level control and a low voltage level control end of the CMOS transmission gate;

the high voltage level control of the first switch element (11) is electrically coupled to the first branch control signal (Demux1), and the low voltage level control end is electrically coupled to the output end of the third inverter (53);

the high voltage level control of the second switch element (12) is electrically coupled to the second branch control signal (Demux2), and the low voltage level control end is electrically coupled to the output end of the fourth inverter (54).

5. The demultiplex type display driving circuit according to claim 3, wherein the first branch control signal (Demux1) and the second branch control signal (Demux2) are inverse in phase.

6. The demultiplex type display driving circuit according to claim 1, wherein both the third switch element (21) and the fifth element (31) are N type TFTs, and both the fourth switch element (22) and the sixth switch element (32) are P type TFT;

the control ends, the input ends and the output ends of the third switch element (21) and the fifth switch element (31) respectively correspond to a gate, a source and a drain of the N type TFT;

the control ends, the input ends and the output ends of the fourth switch element (22) and the sixth switch element (32) respectively correspond to a gate, a source and a drain of the P type TFT.

7. The demultiplex type display driving circuit according to claim 1, wherein the sub pixels (40) of multiple rows, four columns in each drive unit respectively are: red sub pixels (R) of one column, green sub pixels (G) of one column, blue sub pixels (B) of one column and white sub pixels (W) of one column, which are sequentially aligned.

8. The demultiplex type display driving circuit according to claim 7, wherein the first branch control signal (Demux1), the second branch control signal (Demux2) and the third branch control signal (Demux3) are combined with one another to sequentially input the data signal (Input) to the first, the second, the third and the fourth data lines (D1, D2, D3, D4) to respectively charge the red sub pixel (R), the green sub pixel (G), the blue sub pixel (B) and the white sub pixel (W).

9. The demultiplex type display driving circuit according to claim 8, wherein as charging the red sub pixel, the first switch element (11), the third switch element (21) and the fifth switch element (31) are on, and the second switch element (12), the fourth switch element (22) and the sixth switch element (32) are off;

as charging the green sub pixel, the first switch element (11), the fourth switch element (22) and the sixth switch element (32) are on, and the second switch element (12), the third switch element (21) and the fifth switch element (31) are off;

as charging the blue sub pixel, the second switch element (12), the third switch element (21) and the fifth switch element (31) are on, and the first switch element (11), the fourth switch element (22) and the sixth switch element (32) are off;

as charging the white sub pixel, the second switch element (12), the fourth switch element (22) and the sixth switch element (32) are on, and the first switch element (11), the third switch element (21) and the fifth switch element (31) are off.

* * * * *